United States Patent [19]

Niikawa

[11] Patent Number: 5,033,890

[45] Date of Patent: Jul. 23, 1991

[54] SHEET FEEDER FOR PRINTER

[75] Inventor: Takeshi Niikawa, Nagoya, Japan

[73] Assignee: Brother Kogyo Kabushiki Kaisha, Japan

[21] Appl. No.: 564,854

[22] Filed: Aug. 9, 1990

[30] Foreign Application Priority Data

Nov. 10, 1989 [JP] Japan ..... 1-292779

[51] Int. Cl.[5] ..... B65H 5/26

[52] U.S. Cl. ..... 400/605; 271/9

[58] Field of Search ..... 271/9, 111; 400/605

[56] References Cited

U.S. PATENT DOCUMENTS

| | | | |
|---|---|---|---|
| 4,190,246 | 2/1980 | Sasuga | 271/9 |
| 4,589,785 | 5/1986 | Sato . | |
| 4,756,636 | 7/1988 | Maruyama et al. . | |
| 4,929,104 | 5/1990 | Yokoi et al. | 400/605 |
| 4,974,019 | 11/1990 | Nishioka et al. | 271/9 |

FOREIGN PATENT DOCUMENTS

| | | | |
|---|---|---|---|
| 227116 | 7/1987 | European Pat. Off. | 400/605 |
| 2221451 | 2/1990 | United Kingdom | 271/9 |

*Primary Examiner*—Robert P. Olszewski
*Assistant Examiner*—Steve Reiss
*Attorney, Agent, or Firm*—Oliff & Berridge

[57] ABSTRACT

A sheet feeder control for a plurality of sheet feeding mechanisms. When one of the plural sheet feeding mechanisms is selected, the thus-selected sheet feeding mechanism is driven by the sheet feeding mechanism drive section to feed its sheet to the printing section. The non-volatile memory retains, in a non-volatile manner, the information which specifies the sheet feeding mechanism thus selected before the power supply is turned off. On the other hand, when the power supply is turned on again after its removal, it is detected by the sheet discriminating section whether a sheet is placed in the vicinity of the printing section. When the sheet is detected, its kind is also discriminated. When a sheet is detected in the vicinity of the printing section and its kind is discriminated, the preferential drive mechanism drives the sheet feeding mechanism corresponding to the sheet so that the sheet is fed to the printing section. When no sheet is detected by the sheet discriminating section, on the other hand, the preferential drive section drives the sheet feeding mechanism corresponding to the information stored in the non-volatile memory so that a sheet corresponding to the sheet feeding mechanism set before the removal of the power supply is fed to the printing section.

15 Claims, 4 Drawing Sheets

SHEET FEEDER FOR PRINTER

BACKGROUND OF THE INVENTION

1. Field of the Invention

The present invention relates to a sheet feeder for a printer, and specifically to a sheet feeder for a printer which selectively drives one of plural sheet feeding mechanisms to feed the corresponding sheet to a printing section of the printer.

2. Description of the Related Art

Conventional sheet feeders for printers include, for example, those capable of permitting plural sheet feeding modes such as an ACSF mode in which an auto cut sheet feeder (ACSF) is driven to automatically feed cut sheets one after another to a printing section, a continuous sheet feeding mode in which a tractor is driven to continuously feed a continuous sheet to a printing section, and a manual feeding mode in which sheet feed rollers arranged at a sheet-input slot of a printer are driven to manually feed a cut sheet to a printing section. In a printer equipped with such sheet feeding modes, respective drive mechanisms for ACSF, tractor, sheet feed rollers and the like for the various sheet feeding modes are associated with their corresponding sheet feeding mode selection keys on a control panel. A desired sheet feeding mode is selected upon feeding paper sheets, whereby the drive mechanism corresponding to the sheet feeding mode so selected is actuated. As a result, a paper sheet associated with the drive mechanism is automatically fed to a printing section.

Sheet feeders for printers, in which the feeding of a sheet is automated as described above, include those capable of storing the sheet feeding mode before removal of the power supply in a non-volatile manner by using an EEPROM or the like. Even when the power supply is once turned off to perform maintenance work for the elimination of a trouble such as a paper jam, such a sheet feeder is automatically reset in the sheet feeding mode before the removal of the power supply as soon as the power supply is turned on again.

However, such a sheet feeder is accompanied by the irksomeness that after its power supply has been turned off and any jammed sheet has been removed, a sheet different from that being printed before the removal of the power supply must be manually set in the printing section before the power supply is turned on again. Basically, no manual sheet setting is required for an automated sheet feeder. Such manual sheet setting is however needed in some instances, for example, upon jamming of a paper sheet or loading a continuous sheet on the feeder. Whenever a sheet is set by such a manual operation, a conventional sheet feeder automatically ejects the manually-set sheet and feeds a sheet, which corresponds to the paper feeding mode before the removal of the power supply, to the printing section. As a result, the operator cannot print on the intended sheet. If the sheet set by this manual operation is a continuous sheet, printing on the intended continuous sheet is not feasible and moreover, the continuous sheet may be ejected over a substantial length. Such large wasting of a continuous sheet takes place when the sheet feeder is reactuated in the cut sheet feeding mode.

SUMMARY OF THE INVENTION

An object of the present invention is to provide a sheet feeder for a printer, which accurately discriminates a paper sheet as desired by an operator and feeds the same.

A sheet feeder according to the present invention, which is suitable for use with a printer, therefore has a means for selecting one of plural sheet feeding mechanisms; a means for driving the sheet feeding mechanism selected by the sheet feeding mechanism selecting means, whereby a sheet associated with the thus-selected sheet feeding mechanism is fed to a printing section; a non-volatile memory means for storing in a non-volatile manner information which specifies the sheet feeding mechanism selected by the sheet feeding mechanism selecting means; a sheet discriminating means for detecting whether a sheet is placed in the vicinity of the printing section upon turning on a power supply and when the sheet is detected, discriminating the kind of the sheet thus detected; and a means for preferentially driving the sheet feeding mechanism corresponding to the information stored in the non-volatile memory means when no sheet is detected by the sheet discriminating means or for preferentially driving the sheet feeding mechanism corresponding to the thus-detected sheet when the sheet is detected and its kind is discriminated, both by the sheet discriminating means.

In the sheet feeder of the present invention, one of the plural sheet feeding mechanisms is selected by the sheet feeding mechanism selecting means so that the thus-selected sheet feeding mechanism is driven by the sheet feeding mechanism drive means to feed its sheet to the printing section. Here, the non-volatile memory means retains, in a non-volatile manner, the information which specifies the sheet feeding mechanism thus selected. On the other hand, when the power supply is turned on again after its removal, it is detected by the sheet discriminating means whether a sheet is placed in the vicinity of the printing section. When the sheet is detected, its kind is also discriminated. When a sheet is detected in the vicinity of the printing section and its kind is discriminated, the preferential drive means drives the sheet feeding mechanism corresponding to the sheet so that the sheet is fed to the printing section. When no sheet is detected by the sheet discriminating means on the other hand, the preferential drive means drives the sheet feeding mechanism corresponding to the information stored in the non-volatile memory means so that a sheet corresponding to the sheet feeding mode set before the removal of the power supply is fed to the printing section.

According to the sheet feeder of the present invention, the presence of a sheet in the printing section at the time of application of power lakes it possible to drive the corresponding sheet feeding mechanism in preference to the sheet feeding mechanism set before the removal of the power supply. The sheet feeder of the present invention can therefore exhibit the superb effect that a sheet desired by an operator can be accurately discriminated and fed no matter whether it is desired to print on a sheet placed by a manual operation or on a sheet corresponding to a sheet feeding mode set before removal of the power supply.

BRIEF DESCRIPTION OF THE DRAWINGS

A preferred embodiment of the present invention will be described in detail with reference to the following figures, wherein.

DESCRIPTION OF THE PREFERRED EMBODIMENT

The sheet feeder according to the preferred embodiment of the present invention will hereinafter be described.

Figure 1:
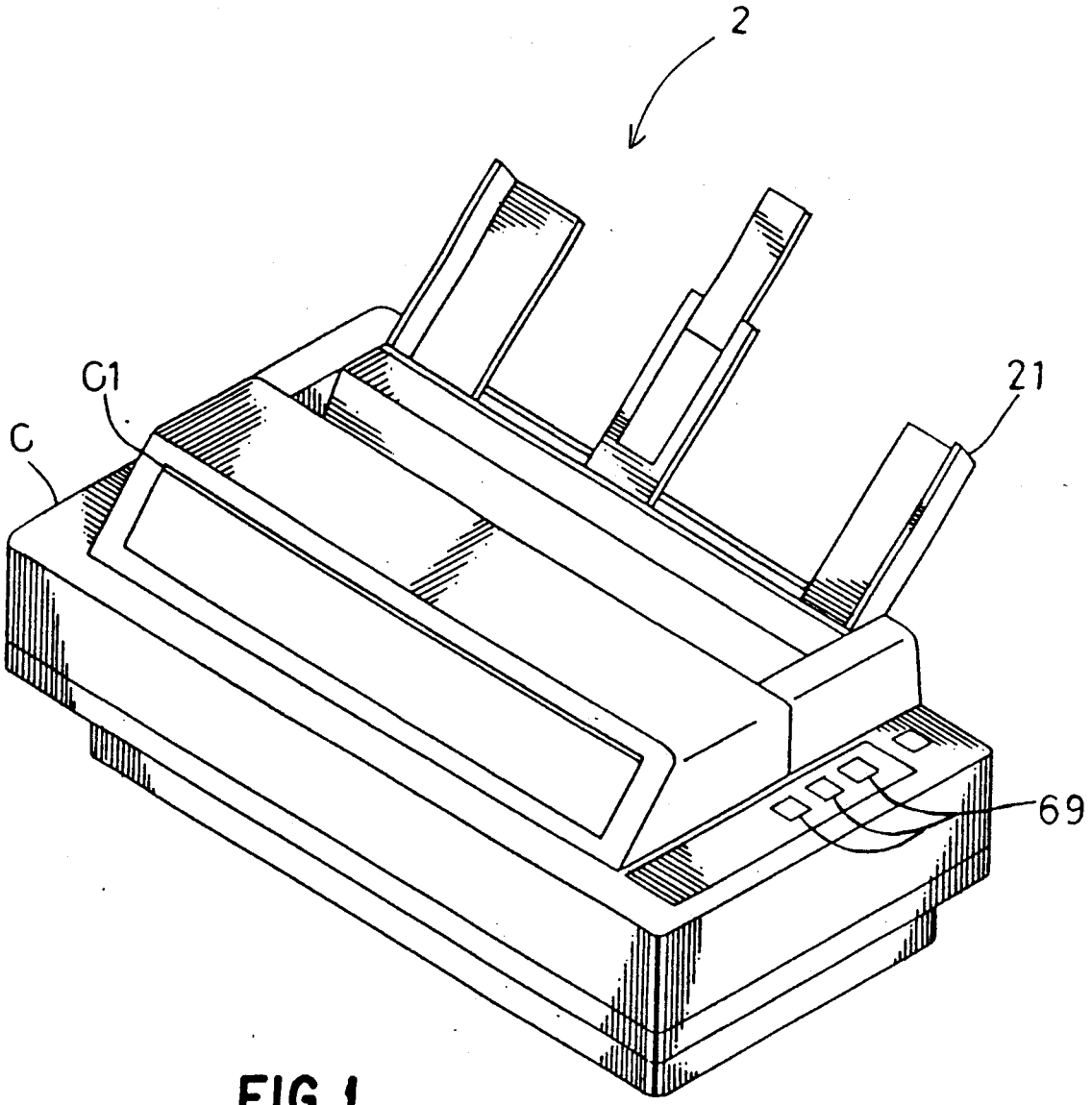
FIG. 1 is a perspective view of a printer equipped with a sheet feeder according to one embodiment of the present invention.
Figure 2:
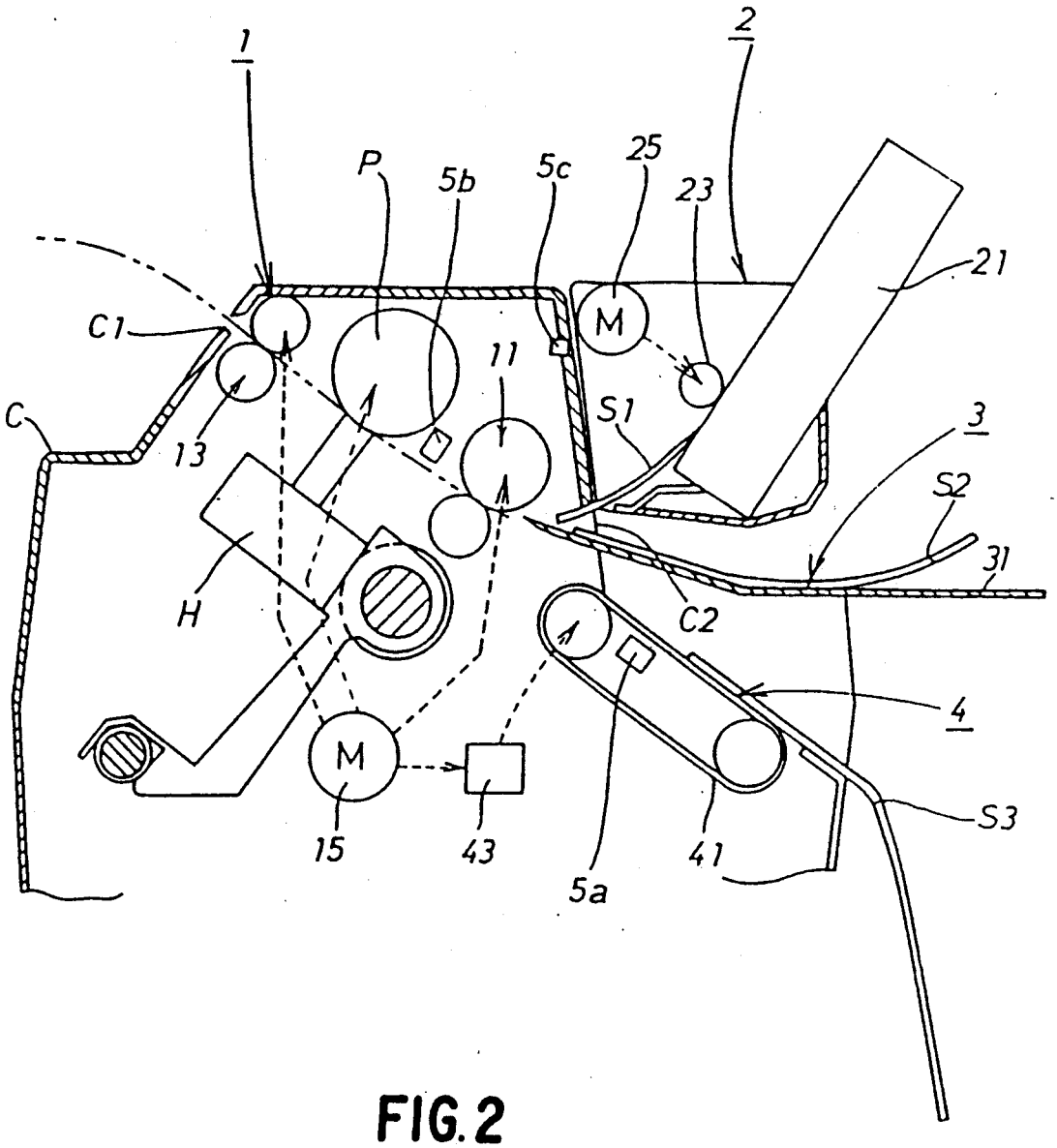
FIG. 2 is a cross-sectional view showing the outline of the construction of the sheet feeder.

As is depicted in FIG. 2, the sheet feeder of the embodiment is provided with a sheet feeding roller mechanism 1 arranged on both upstream and downstream sides of a platen P and a printing head H to feed a sheet, an automatic cut sheet feeder (hereinafter it is abbreviated an ACSF) 2 for feeding out cut sheets S! one after another toward the sheet feeding roller mechanism !, a manual feeding device 3 for guiding toward the sheet feeding roller mechanism 1 a sheet S2 fed manually, and a continuous sheet feeding portion 4 for feeding out a continuous sheet S3 toward the sheet feeding roller mechanism 1. Various detection switches 5 are arranged in the paper feeding roller mechanism 1, ACSF 2 and continuous sheet feeding portion 4, respectively.

The sheet feeding roller mechanism I of the embodiment includes two sets of paper feeding rollers 1!, 13 which extend in the axial direction of the platen P. One of the sheet feeding roller sets, namely, the sheet feeding rollers I! are disposed in the vicinity of the platen P and on the side of the ACSF 2, manual feeding device 3 and continuous sheet feeding portion 4. The other set, namely, the sheet feeding rollers 13 are arranged near a sheet-output slot Cl formed in a printer casing C. The sheet feeding rollers !!, !3 in the respective sets are driven by a common motor !5 via an unillustrated power transmission mechanism. Drive power of the motor 15 is transmitted to the platen P by way of a power transmission mechanism, not illustrated. As a consequence, the platen P and the sheet feeding rollers 11, 13 are rotated in unison to transport the sheet whenever the printing line is changed.

The ACSF 2 is equipped with a cut sheet tray 21 in which the cut sheets S1 are stored, a pickup roller 23 maintained in contact with the top sheet in the tray 21, and a motor 25 for driving the pickup roller 23. Upon feeding sheets, the pickup roller 23 is turned over a predetermined angle to feed out the sheets S1 one after another from the cut sheet tray 21 toward the sheet feeding rollers 11 through a sheet-input slot C2 formed in a rear wall of the printer casing C. The ACSF 2 is detachably mounted on the printer casing C.

Extending through the manual feeding device 3 is a guide plate 31 which guides the sheet S2 from the sheet-input slot C2 in the rear wall of the printer casing 2 to a point close to the sheet feeding rollers 11. The sheet S2 which has been inserted manually through the sheet-input slot C2 is guided toward the paper feeding rollers 11.

The continuous sheet feeding portion 4 has a pin tractor 41 arranged in the proximity of the sheet-input slot C2. The pin tractor 41 is connected to the motor 15 of the sheet feeding roller mechanism by way of an unillustrated power transmission mechanism and a clutch 43. Upon feeding a sheet, the pin tractor 41 continuously feeds the continuous sheet S3, which has been transported into the printer through the sheet-input slot C2, toward the sheet feeding rollers 11.

Among the various sensors **5*a*, 5*b*, and 5*c* arranged at prescribed positions of the above respective mechanisms, a sensor 5*a* which is provided inside the space defined by the tractor 41 and at the height of the path of the continuous sheet S3 detects whether the continuous sheet S3 is passed by the tractor 41. A sensor 5*b* provided immediately before the platen P detects whether a sheet is placed in the printing section. Each of these sensors 5*a* and 5*b* comprises a photosensor for detecting the sheet. A sensor 5*c* arranged on the printer casing C on which the ACSF 2 is mounted detects whether the ACSF 2 is mounted or not. This sensor 5*c* comprises a movable portion being depressed by a body of the ACSF 2 when the ACSF 2 is mounted and outputs a detection signal to an electronic controller 6**.

Figure 3:
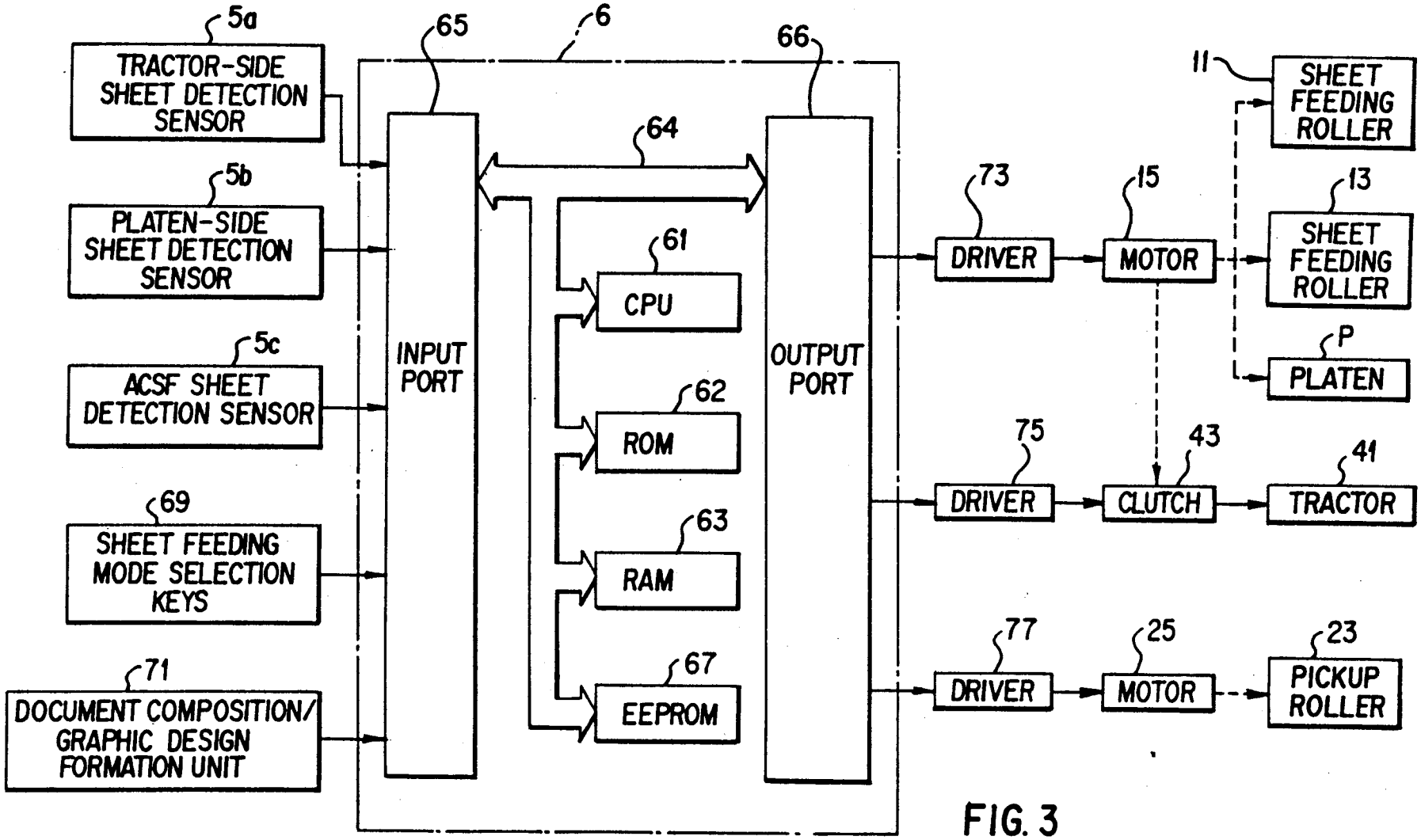
FIG. 3 is a block diagram illustrating the construction of an electronic controller for the sheet feeder.

The electronic controller 6 for the paper feeding roller mechanism 1, ACSF 2 and continuous sheet feeding portion 4, which have been described above, is constructed as an arithmetic and logic unit, centering at known CPU 61, ROM 62 and RAM 63 as depicted in FIG. 3. The electronic controller 6 performs input and output of data with external devices through an input port 65 and an output port 66 which are connected with the CPU 61, ROM 62 and RAM 63 via a bus 64. In the illustrated embodiment, an erasable and electrically reprogrammable ROM (hereinafter is abbreviated as EEPROM) 67 is also connected to the CPU via the bus 64. Connected to the input port 65 are sheet feed mode selection keys 69 on a control panel, a document composition/graphic design formation unit 71, etc. in addition to the tractor-side sheet detection switch **5*a*, the platen-side sheet detection switch 5*b* and the ACSF-side sensor 5*c*, all the sensors having been described above. To the output port 66, there are connected a driver 73 for the motor 15 adapted to drive the sheet feeding roller mechanism a driver 75 for the clutch 43 adapted to connect the motor !5 to the tractor 41, a driver 77 for the motor 25 adapted to drive the pickup roller 23 of the ACSF 2, etc. The electronic controller 6 executes a program stored in the ROM 62**, whereby the respective sheet feeding mechanisms are driven under control.

Figure 4:
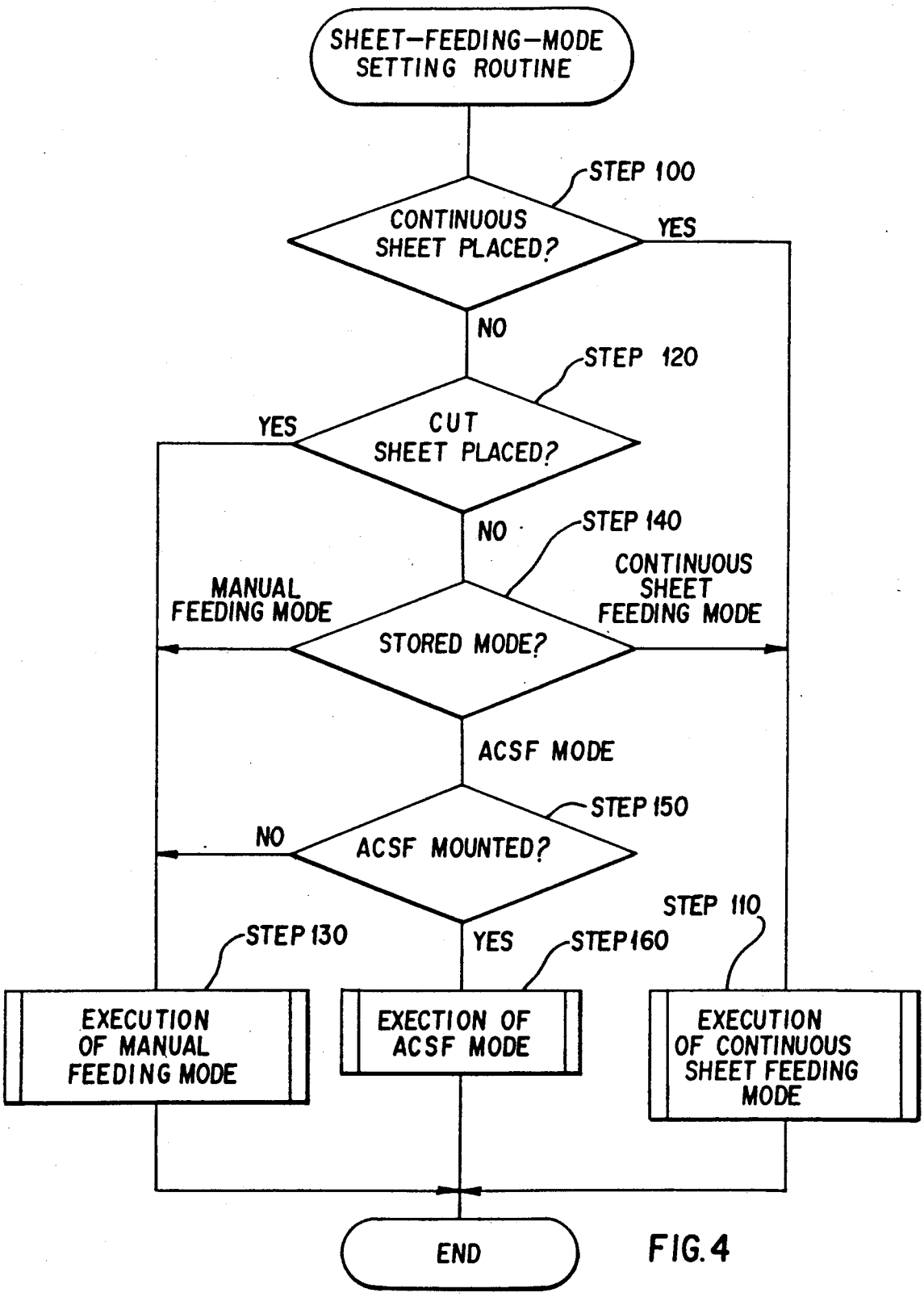
FIG. 4 is a flow chart of processing performed by the electronic controller.

Next, a sheet-feeding-mode setting routine which is executed by the CPU 61 of the electronic controller 6 will be described in accordance with the flow chart of FIG. 4. Incidentally, this routine is executed whenever the power supply is turned on.

When this routine is initiated, processing (Step 100) is performed first of all to determine whether the continuous sheet S3 is placed at the printing position. The detection of the continuous sheet S3 is effected by means of the tractor-side sheet sensor **5*a* and the platenside sheet sensor 5*b*. A standby position for the continuous sheet S3 is right before the sheet sensor 5*a* as shown in FIG. 2. The continuous sheet S3 is thus determined to be placed at the printing position when the two sheet sensors 5*a*, 5*b*** ar each in an ON state.

Assume that placement of continuous sheet S3 at the printing position has been determined in Step 100. The continuous sheet feeding mode is then executed irrespective of the sheet feeding mode before the removal of the power supply (Step 110). In Step 110, the continuous sheet feeding mode is performed in the following manner. The clutch 43 is driven to establish a power transmission mechanism between the tractor 41 and the motor 15 of the sheet feeding roller mechanism 1, whereby the tractor 41 and the sheet feeding rollers 11, 13 are driven in unison to feed the continuous sheet S3 to the printing position under control.

Assume that absence of the continuous sheet S3 at the printing position has been determined from the states of the sheet sensors 5*a*, 5*b* on the other hand (Step 100). Processing (Step 120) is then conducted to determine whether the cut sheet S2 is placed at the printing position. The cut sheet S2 is determined to be placed at the printing position when the platen-side sheet sensor 5*b* is in an ON state and the tractor-side sheet sensor 5*a* is in an OFF state.

When the cut sheet S2 has been determined to be placed at the printinq position from the states of the sheet sensors 5*a*, 5*b* in Step 120, the manual feeding mode is executed in Step 130 so that the sheet feeding rollers 11, 13 are rotated in unison with the platen P to feed the cut sheet S2 gradually under control in accordance with the progress of the printing.

Assume that absence of the cut sheet S2 at the printing position has been determined in Step 120. Then, the sheet feeding mode before the removal of the power supply is read out from a predetermined region of the EEPROM 67 so that processing is performed to determine the kind of the mode stored (Step 140).

When the stored mode has been found to be the continuous sheet feeding mode in Sept 140, the continuous sheet feeding mode described above is executed in Step 110.

Assume next that the stored mode has been found to be the ACSF mode in Step 140. The ON/OFF state of the ACSF-side detection switch 5*c* is then read in, whereby it is determined whether the ACSF 2 is mounted or not (Step 150). If mounted (Step 150), the ACSF mode is performed in Step 160. Namely, the motor 25 which drives the pickup roller 23 of the ACSF 2 is controlled to feed out the cut sheets S1 one after another toward the sheet feeding rollers These cut sheets S1 are then fed under control to the printing position by the sheet feeding rollers 11, 13 and the platen P.

Assume that the ACSF 2 has been found not to be mounted conversely in Step 150 or the stored mode has been found the manual feeding mode in Step !40. The manual feeding mode described above is then performed in Step 150.

According to the sheet feeder of the embodiment described above, the continuous sheet feeding mode or the manual feeding mode is preferentially performed as long as the continuous sheet S3 or the cut sheet S2 is set at the printing position when the power supply is turned on. On the other hand, the sheet feeding mode before the removal of the power supply is automatically executed when neither the continuous sheet S3 nor the cut sheet S2 is set there upon application of power. The sheet feeder of the present embodiment can therefore bring about the excellent advantage that printing can be performed on the continuous sheet S3 or the cut sheet S2 even when the operator erroneously sets the continuous sheet S3 or the cut sheet S2 by a manual operation. It is therefore possible to completely solve the problem which arises in conventional sheet feeders, especially when the continuous sheet S3 is set by a manual operation, namely, the problem of large wasting of the continuous sheet S3.

The present invention has been described above on the basis of the preferred embodiment. It is, however, to be noted that the present invention is by no means limited to the above embodiment and can be practiced in various ways unless the spirit of the present invention is departed. For example, it is possible to use as the non-volatile memory means a RAM backed up by a battery or the like or a means having default setting function by a DIP switch or the like, besides the use of the EEPROM. The above embodiment can also be modified to simply make the continuous sheet S3 recede to a standby position upstream of the sensor 5*a* and to perform control on the basis of the mode stored in the EEPROM 67, when the tractor-side sensor 5*a* and the platen-side sheet sensor 5*b* are in ON state and OFF state, respectively, when the power supply is turned on. It may also be judged that printing is to be performed on the continuous sheet S3, as the continuous sheet S3 has been fed to an intermediate point. Accordingly, the continuous sheet S3 may be fed further to the printing position, or the continuous sheet S3 may be once fed back to the standby position upstream of the sheet detection switch 5*a* to position the leading end of the continuous sheet S3 at a predetermined point and then to automatically feed it to the printing position.

Further, the present invention can be applied in exactly the same manner to printing mechanisms equipped with a keyboard, such as typewriters and word processors.

What is claimed is:

1. A sheet feeder comprising:

plural sheet feeding mechanisms, each for feeding a sheet installed therein;

a sheet feeding mechanism selecting means for selecting one of said plural sheet feeding mechanisms;

a driving means for driving the sheet feeding mechanism selected by the sheet feeding mechanism selecting means, whereby a sheet installed in the selected sheet feeding mechanism is fed to a printing unit;

an indicating means for indicating the sheet feeding mechanism selected by the sheet feeding mechanism selecting means;

a sheet discriminating means for detecting whether a sheet is placed in the vicinity of the printing unit upon turning on a power supply, and discriminating the kind of the detected sheet when the sheet is detected; and a preferential drive means for driving the sheet feeding mechanism indicated by said indicating means when no sheet is detected by the sheet discriminating means and for driving the sheet feeding mechanism corresponding to the detected sheet instead of driving the sheet feeding mechanism indicated by said indicating means when the sheet is detected and its kind is discriminated.

2. Apparatus as in claim 1, wherein said indicating means comprises a non-volatile memory means for storing information corresponding to the sheet feeding mechanism selected by said selecting means.

3. Apparatus as in claim 1, wherein said sheet discriminating means discriminates the sheet feeding mechanism which feeds the detected sheet.

4. A sheet feeder comprising:

plural sheet feeding mechanisms, each for feeding a sheet installed therein, which include at least a removable sheet feeding mechanism and a manual sheet feeding mechanism;

a detection means for detecting whether the removable sheet feeding mechanism is installed or not;

a sheet feeding mechanism selecting means for selecting one of said plural sheet feeding mechanisms;

a driving means for driving the sheet feeding mechanism selected by the sheet feeding mechanism selecting means, whereby a sheet installed in the selected sheet feeding mechanism is fed to a printing unit;

an indicating means for indicating the sheet feeding mechanism selected by the sheet feeding mechanism selecting means;

a sheet discriminating means for detecting whether a sheet is placed in the vicinity of the printing unit upon turning on a power supply, and discriminating the kind of the detected sheet when the sheet is detected; and a preferential drive means for driving the sheet feeding mechanism corresponding to that indicated by said indicating means when no sheet is detected by the sheet discriminating means, and for driving the sheet feeding mechanism corresponding to the detected sheet instead of driving the sheet feeding mechanism indicated by the indicating means when the sheet is detected and its kind is discriminated, and for enabling the manual sheet mechanism when no sheet is detected, the removable sheet feeding mechanism is not installed and said indicating means indicates the removable sheet feeding mechanism.

5. Apparatus as in claim 4, wherein said indicating means comprises a non-volatile memory means for storing information corresponding to the sheet feeding mechanism selected by said selecting means.

6. Apparatus as in claim 4, wherein said sheet discriminating means discriminates the sheet feeding mechanism which feeds the detected sheet.

7. Printing apparatus for printing on a plurality of types of sheets comprising:

a plurality of means for feeding sheets including means for automatically feeding sheets and means for manually feeding sheets;

sheet feed mode selecting means for selectively enabling said automatic sheet feeding means and said manual sheet feeding means;

a printing portion at which the sheets are printed;

feed control means operative after cessation of a sheet feeding operation for enabling operation of the sheet feeding means in operation just prior to the cessation; said control means including means for detecting a sheet in the vicinity of the printing portion after said cessation and for preferentially enabling feeding of said detected sheet by the manual feeding means, if said sheet is set for a position for manual feeding.

8. Apparatus as in claim 7, wherein said control means selectively enables operation of said sheet feeding means corresponding to the detected sheet after cessation caused by an interruption in power applied to the printer.

9. Apparatus as in claim 7 and further comprising a plurality of automatic sheet feeding means and wherein the control means includes means for discriminating between types of sheets positioned for feeding by the feeding means after said cessation of feeding and for causing said discriminated sheet to be fed irrespective of the feeding means selected by the feed mode selecting means.

10. Apparatus as in claim 9, wherein said control means selectively enables operation of said sheet feeding means corresponding to the detected sheet after cessation caused by an interruption in power applied to the printer.

11. Apparatus as in claim 10, wherein the feed control means includes means for defaulting to the feed mode selecting means when said detecting means fails to detect the presence of a sheet.

12. A printer comprising:

a printing unit;

an automatic cut sheet feeding means;

a continuous sheet feeding means;

a manual sheet feeding means;

feed selection means for enabling the feeding of sheets selectively to the printing unit from the automatic cut sheet feeding means, the continuous sheet feeding means or the manual sheet feeding means;

detecting means for detecting the presence of a sheet in the vicinity of the printing unit;

discriminating means for discriminating the type of sheet detected by the detecting means in the vicinity of the printing unit; and control means for selectively enabling operation of the sheet feeding means corresponding to the sheet of the type discriminated by the discriminating means, after cessation of sheet feeding selected by the feed selection means, irrespective of the sheet feeding means selected by the feed selecting means.

13. Apparatus as in claim 12, wherein the control means includes a detecting means associated with the continuous sheet feeding means for detecting the location of a continuous sheet in a position to be fed to the printing unit.

14. Apparatus as in claim 13, wherein the automatic cut sheet feeding means is removable and the control means includes mounting detecting means for detecting the mounting of the automatic cut sheet feeding means on the printer.

15. Apparatus as in claim 14, wherein the control means includes means for enabling the manual sheet feeding means when no sheet is detected by the detecting means and the removable automatic sheet feeding means is not detected by the mounting detecting means.

* * * * *